US006844035B2

(12) United States Patent
Niu et al.

(10) Patent No.: US 6,844,035 B2
(45) Date of Patent: Jan. 18, 2005

(54) PRINT MEDIA PRODUCTS FOR GENERATING HIGH QUALITY IMAGES AND METHODS FOR MAKING THE SAME

(75) Inventors: Bor-Jiunn Niu, San Diego, CA (US); Stefan Schuttel, Murten (CH); Meinrad Schaer, Ependes (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/775,655

(22) Filed: Feb. 9, 2004

(65) Prior Publication Data

US 2004/0161555 A1 Aug. 19, 2004

Related U.S. Application Data

(63) Continuation of application No. 10/140,125, filed on May 6, 2002, now Pat. No. 6,689,433.

(51) Int. Cl.[7] ..... B41M 5/40

(52) U.S. Cl. ..... 428/32.38; 428/32.25; 428/32.26; 428/32.27; 428/32.28; 428/32.34; 428/32.24

(58) Field of Search ..... 428/32.38, 32.25, 428/32.26, 32.27, 32.28, 32.34, 32.24

(56) References Cited

U.S. PATENT DOCUMENTS 4,440,827 A 4/1984 Miyamoto et al.
4,474,847 A 10/1984 Schroder et al.
4,642,247 A 2/1987 Mouri et al.
4,780,356 A 10/1988 Otouma et al.
4,879,166 A 11/1989 Misuda et al.
5,008,231 A 4/1991 Yoshizawa et al.
5,104,730 A 4/1992 Misuda et al.
5,141,797 A 8/1992 Wheeler
5,194,347 A 3/1993 Vermeulen et al.
5,266,383 A 11/1993 Sakaki et al.
5,277,965 A 1/1994 Malhotra
5,354,634 A 10/1994 Misuda et al.
5,397,619 A 3/1995 Kuroyama et al.
5,429,860 A 7/1995 Held et al.
5,472,773 A 12/1995 Misuda et al.
5,514,636 A 5/1996 Takeuchi
5,576,088 A 11/1996 Ogawa et al.
5,605,750 A 2/1997 Romano et al.
5,635,297 A 6/1997 Ogawa et al.
5,665,504 A 9/1997 Malhotra
5,691,046 A 11/1997 Matsubara et al.
5,723,211 A 3/1998 Romano et al.
5,744,273 A 4/1998 Malhotra
5,755,929 A 5/1998 Kuroyama et al.
5,804,293 A 9/1998 Nehmsmann et al.
5,846,637 A 12/1998 Malhotra et al.
5,863,648 A 1/1999 Ohmura et al.
5,880,196 A 3/1999 Cho et al.
5,882,388 A 3/1999 Adair et al.
5,897,961 A 4/1999 Malhotra et al.
5,912,071 A 6/1999 Takeshita et al.
5,916,673 A 6/1999 Fryberg et al.
5,919,552 A 7/1999 Malhotra
5,962,124 A 10/1999 Yoshino et al.
5,965,244 A 10/1999 Tang et al.
5,977,019 A 11/1999 Ozeki et al.
5,985,076 A 11/1999 Misuda et al.
6,089,704 A 7/2000 Burns et al.
6,225,381 B1 5/2001 Sharma et al.
6,528,148 B2 3/2003 Niu et al.
6,689,433 B2 * 2/2004 Niu et al. ..... 428/32.38
2002/0089568 A1 7/2002 King et al.
2003/0072955 A1 4/2003 Niu et al.

* cited by examiner

*Primary Examiner*—B. Shewareged

(57) ABSTRACT

Ink-receiving print media products capable of producing high quality printed images which are light-fast, humid-fast, have low coalescence (graininess) levels, and are characterized by other beneficial attributes. The print media products have at least one ink-receiving layer supported by a substrate. The ink-receiving layer includes a binder blend designed to achieve the aforementioned goals, namely, gelatin, a poly(vinyl alcohol-polyethylene oxide) copolymer, and a poly((styrene)-(n-butyl acrylate)-(methyl methacrylate)-(2-(tert-butylamino) ethyl methacrylate)) copolymer. One or more optional pigments and/or additional binders can also be included within the ink-receiving layer. The ink-receiving layer may optionally be employed in combination with one or more additional material layers thereover or thereunder which can contain, for example, one or more pigments and/or binders.

12 Claims, 2 Drawing Sheets

PRINT MEDIA PRODUCTS FOR GENERATING HIGH QUALITY IMAGES AND METHODS FOR MAKING THE SAME

REFERENCE TO RELATED APPLICATIONS

This application is a continuation of application Ser. No. 10/140,125 filed May, 6, 2002, now U.S. Pat. No. 6,689,433.

BACKGROUND

In order to effectively generate printed images using the various ink transfer techniques and systems (with primary but not necessarily exclusive reference to thermal inkjet technology), ink-receiving print media materials must be employed which are capable of efficiently accomplishing this goal. Ideally, to achieve maximum efficiency, print media materials should be able to provide numerous advantages and benefits including but not limited to (1) a high level of light-fastness, with the term "light-fastness" being generally defined herein to involve the capacity of a print media product to retain images thereon in a stable fashion without substantial fading, blurring, distortion, and the like over time in the presence of natural or made-made light; (2) rapid drying times in order to avoid smudging and image deterioration immediately after printing is completed due to contact with physical objects and the like; (3) the fast and complete absorption of ink materials in a manner which avoids image distortion caused by color bleed (namely, the undesired migration of multi-colored ink components into each other) and related difficulties; (4) a highly humid-fast character (with the term "humid-fast" being generally defined to involve the ability of a print media product to produce a stable image with little or no fading, run-off, distortion, and the like when the image is placed in contact with moisture, humidity, and the like (also known in a substantially equivalent fashion as "water-fastness")); (5) the generation of "crisp" images with a distinct and defined character; (6) the ability to produce printed products which are substantially "smear-fast", with this term being generally defined to comprise the production of images that will not exhibit smearing, blurring, and the like when rubbed or otherwise physically engaged with a variety of objects ranging from the components of the printing apparatus being employed to the print operator's hands, fingers, and the like; (7) the control of an undesired condition known as "ink-coalescence" which is defined herein to involve a phenomenon wherein wet ink droplets applied to a printing medium fail to spread sufficiently to eliminate the unprinted (e.g. open) space between the droplets, thereby causing significant image deterioration problems which are primarily manifested by the increased "graininess" of the image; (8) the capacity to generate printed images with desired levels of gloss wherein the final product is characterized by uniform gloss levels throughout the entire image in order to achieve a professional and aesthetically-pleasing printed media sheet; (9) the ability to attain a high level of consistency during large-scale production regarding the overall surface characteristics of the completed media products; (10) low material costs which enable the print media products of interest to be employed for mass market home and business use; (11) chemical compatibility with a wide variety of ink formulations which leads to greater overall versatility; (12) excellent levels of image stability and retention over long time periods; (13) minimal complexity from a production, material-content, and layer-number standpoint (with as few required layers as possible being desirable) which leads to reduced fabrication costs and greater product reliability; and (14) a high level of gloss-control which is achievable in a rapid and effective manner during production through only minor adjustments in the manufacturing process. The term "gloss-control" is generally defined herein to involve the ability, during fabrication, to generate a print media product having high gloss levels for the production of photographic quality images if desired, a semi-gloss character if needed, or other gloss parameters. In particular, the manufacturing process should be highly controllable in order to achieve a variety of different gloss characteristics without requiring major adjustments in processing steps and materials.

A need remains for print media materials (namely, ink-receiving sheets or structures) which are able to capture and retain clear, distinct, and accurate images thereon that are likewise characterized by a number of specific benefits in combination. These benefits include but are not limited to items (1)–(14) recited above both on an individual and simultaneous basis in a substantially automatic manner (with the simultaneous achievement of such goals being of particular importance and novelty). The attainment of these objectives is especially important regarding the following specific items: a high level of humid-fastness, excellent light-fastness, an effective level of ink-coalescence control in order to prevent excessive "graininess" (namely, the undesired appearance of large "grain-like" elements in the printed product), and the generation of clear, durable, smear-fast, and distinct printed images.

SUMMARY

The following discussion shall constitute a brief and non-limiting general overview. More specific details concerning particular embodiments and other important features (including a recitation of preferred construction materials, chemical ingredients, quantities, and the like) will again be recited in the Detailed Description section set forth below.

In order to produce a preferred print media product in accordance with the present disclosure, a substrate is initially provided. Supported by the substrate is at least one ink-receiving layer (also characterized herein as a "coating formulation" during the production stages thereof, with the ink-receiving layer being produced from a plurality of binders. The plurality of binders (also characterized herein as a "binder blend") will, in a preferred embodiment, involve a First Binder comprised of gelatin, a Second Binder comprised of a poly(vinyl alcohol-ethylene oxide) copolymer, and a Third Binder comprised of a poly ((styrene)-(n-butyl acrylate)-(methyl methacrylate)-(2-(tert-butylamino) ethyl methacrylate)) copolymer.

At least one additional binder may optionally be employed within the foregoing plurality of binder compositions which is different from the First Binder, Second Binder, and the Third Binder. Likewise, the above-mentioned binder blend (with or without any additional binders) may be combined with one or more other ingredients including but not limited to at least one pigment. The employment of one or more pigments shall be considered optional and may include a wide variety of different materials as outlined in considerable detail below.

The claimed ink-receiving layer may likewise be employed as the sole material layer supported by the substrate in the print media product or can be used in combination with one or more additional material layers thereover or thereunder without limitation. For instance, at least one additional material layer can be positioned between the substrate and ink-receiving layer as an "intermediate" or "medial" structure. No limitations or restrictions shall exist involving the additional material layer which can contain a wide variety of different compositions therein including but not limited to pigments, binders, mixtures thereof, and other "supplemental" ingredients as recited below.

Also to be outlined in the Detailed Description section are various methods for producing a print media product wherein the above-mentioned substrate is initially provided. Formed thereon (e.g. over and above the substrate) is the ink-receiving layer discussed above. An optional method step is the providing of at least one or more additional material layers over or under the ink-receiving layer. For example, at least one additional material layer may be formed as an "intermediate" or "medial" structure between the substrate and ink-receiving layer as previously described.

Again, the foregoing discussion shall not limit the invention in any respect and represents only a general overview of certain materials, structures, and methods employed in connection with the claimed print media products.

BRIEF DESCRIPTION OF THE DRAWINGS

The drawing figures provided herein are schematic, representative, and not necessarily drawn to scale. They shall not limit the scope of the invention in any respect. Reference numbers which are carried over from one figure to another shall constitute common subject matter in the figures under consideration. Likewise, the cross-hatching shown in the drawing figures is provided for example purposes only and shall not restrict the invention to any particular construction materials. In addition, the illustration of any given number of elements, components, layers, layering arrangements, layering sequences, and other structural features shall be considered representative only and shall not limit the invention in any respect unless otherwise expressly stated herein.

DETAILED DESCRIPTION

Figure 1:
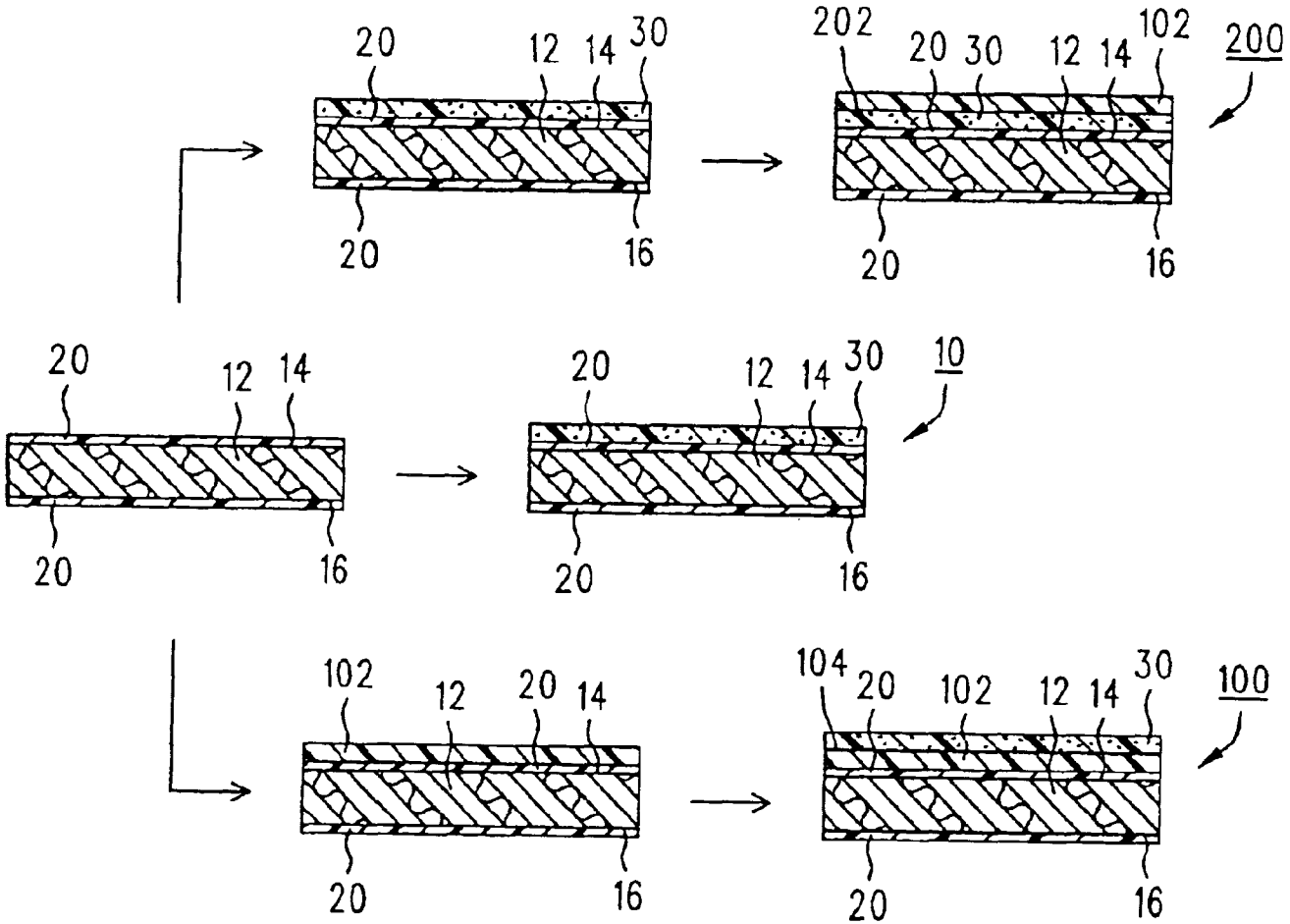
FIG. 1 is a schematically-illustrated, sequential view of the preferred process steps, materials, and techniques that are employed to produce the print media products disclosed and claimed herein.

Novel and effective print media products (also characterized herein as "print media sheets", "ink-receiving sheets", "ink-receiving substrates", "ink-receiving members", and the like) are described in detail below which offer numerous advantages and benefits over prior structures. These benefits and advantages include, without limitation or restriction, the simultaneous achievement of items (1)–(14) recited above with particular reference to (A) a high level of humid-fastness (also characterized herein as "water-fastness"); (B) excellent light-fastness; (C) rapid drying time; (D) a high degree of ink-coalescence control in order to prevent excessive "graininess" as previously discussed; (E) the ability to precisely control the surface characteristics of the print media products in a uniform and consistent manner including gloss parameters and the like; and (F) the generation of clear, durable, smear-fast, and distinct printed images using a minimal quantity of materials and layers. In this regard, the claimed print media products collectively represent a significant advance in the image generation field. It should be noted that the recitation of any particular advantages as discussed herein shall not be considered limiting and is representative only. Other advantages associated with the claimed products, methods, and materials are likewise possible and applicable thereto.

As a preliminary point of information, the print media products of interest shall not be restricted to any particular component types, sizes, material-selections, arrangements of print media materials/structures, chemical compositions, layering sequences, numbers of layers, layer orientations, thickness values, porosity parameters, material quantities, and other related factors unless otherwise expressly stated herein. For example, it shall be understood that one or a plurality of novel ink-receiving layers containing the desired and special ingredient combinations outlined below may be employed in connection with the media sheets of the present invention. In this regard, the print media products associated with the current disclosure shall not be restricted to any number of layers containing the chosen ingredient formulations provided that at least one of such layers is used. Likewise, the location of the ink-receiving layer(s) of interest on or within the media sheet(s) may be varied as desired and employed in combination with one or more other material layers located above or below the claimed layer(s) of concern. It should therefore be emphasized that the print media products under consideration shall cover the ink-receiving layer or layers of interest (namely, those that employ the special ingredient combinations specified herein) regardless of where such layer(s) are located provided that they are able to receive on or within at least part of the ink compositions being delivered by the chosen printing system. Accordingly, the claimed subject matter shall be construed in its broadest sense to cover a print media product (and method for producing the same) which employs at least one ink-receiving layer (regardless of location) having the desired ingredient combinations therein so that this layer can receive at least some of the ink materials being delivered. By using the novel and unique technologies outlined below, a printed image can be generated having the desired characteristics set forth throughout this discussion.

Furthermore, all scientific terms used throughout this discussion shall be construed in accordance with the traditional meanings attributed thereto by individuals skilled in the art to which this invention pertains unless a special definition is provided herein. The numerical values listed in this section and in the other sections presented below constitute preferred embodiments designed to provide optimum results and shall not limit the invention in any respect. In particular, it shall be understood that the specific embodiments discussed herein and illustrated in all of the drawing figures (along with the particular construction materials associated therewith) constitute special versions of the claimed print media products which, while non-limiting in nature, can offer excellent results and are highly distinctive. All recitations of chemical formulae and structures set forth in the following discussion are intended to generally indicate the types of materials which may be used. The recitation of specific chemical compositions which fall within the general formulae and classifications presented below are offered for example purposes only and shall be considered non-limiting unless explicitly stated otherwise.

The claimed invention and its novel developments are applicable to a wide variety of printing systems with particular reference to those that employ thermal inkjet technology as previously discussed. Likewise, a number of different ink materials can be used in connection with the print media sheets discussed herein without limitation, with the term "ink materials" being defined to cover compositions incorporating dyes, pigments, liquid or solid toners, powders, waxes, dispersions, and other colorants without restriction. Furthermore, such materials (e.g. colorants) shall encompass both chromatic (e.g. colored) and achromatic materials (black/white). In this regard, the claimed print media products shall not be considered "ink-specific" or "printing method-specific" in any fashion.

It should also be understood that the present invention shall not be limited to any particular construction techniques (including any given material deposition procedures, layering arrangements, fabrication processes, and the like) unless otherwise stated below. For example, the terms "forming", "applying", "delivering", "placing", "positioning", "operatively attaching", "operatively connecting", "converting", "providing", "layering", and grammatical variants thereof as used throughout this discussion and as claimed shall broadly encompass any appropriate manufacturing procedures including, without limitation, roll-coating, spray-coating, immersion-coating, cast-coating, slot-die coating, curtain coating, rod-coating, blade-coating, roller application, manual or automatic dipping, brush-coating, and other related production methods. In this regard, the invention shall not be considered "production method-specific" unless otherwise expressly stated herein, with the recitation of any particular fabrication techniques, layer deposition methods, number of layers applied in a given step, layer orientations, layer thicknesses, and the like being set forth for example purposes only.

Likewise, it shall be understood that the terms "operative connection", "operative attachment", "in operative connection", "in operative attachment", "operatively attached", "operatively positioned", "positioned on", "located on", "positioned above", "layered on", "positioned over and above", "located over and above", "applied over and above", "formed over and above", "formed under", "supported by", and the like as used and claimed herein shall be broadly construed to encompass a variety of divergent layering arrangements and assembly techniques. These arrangements and techniques include but are not limited to (1) the direct attachment of one material layer to another material layer with no intervening material layers therebetween; and (2) the attachment of one material layer to another material layer with one or more material layers therebetween provided that the one layer being "supported by", "attached to", "connected to", or "positioned over and above" the other layer is somehow "supported" by the other layer (notwithstanding the presence of one or more additional material layers therebetween). Use of the phrase "direct attachment", "directly attached on", "directly attached to", "directly positioned on", "directly located on", "directly affixed to", and the like shall signify a situation wherein a given material layer is secured to another material layer without any intervening material layers therebetween. Any statement used herein which indicates that one layer of material is "above", "over", "positioned over and above", or "on top of" another layer shall involve a situation wherein the particular layer that is "above", "over", "positioned over and above", or "on top of" the other layer in question shall be the outermost of the two layers relative to the external environment. The opposite situation will be applicable regarding use of the terms "below", "under", "beneath", "on the bottom of", and the like. The characterizations recited above (with particular reference to "positioned over and above") shall be effective regardless of the orientation of the print media materials under consideration and, for example, shall encompass a situation where the ink-receiving layer of interest may be placed on either side of the substrate in question. Again, in the current invention, the claimed ink-receiving layer or layers may be located at any position on or within the print media sheet provided that at least some of the ink materials being delivered by the chosen printing system are able to come in contact with such layer or layers, followed by the receipt of ink materials therein and/or thereon. Thus, while some or all of the drawing figures associated with this invention (and the preferred embodiments discussed below) shall illustrate the claimed ink-receiving layer(s) on top of the media sheet as the uppermost/outermost structures which are exposed to the external environment with no other layers thereon, the claimed invention shall not be restricted to this design which is offered for example purposes only. In this regard, one or more other layers of material may be placed over or under the ink-receiving layers of interest in accordance with the explanation provided above.

As an additional point of information, the terms "top", "uppermost", and "outermost" as applied to a given layer in the claimed structure shall again be construed to involve that layer which is at the top of the print media product in question with no other layers thereon that is exposed to the external environment. When such layer faces the ink delivery components of the printer unit, it is typically the first component of the media product to receive incoming ink materials with no other layers thereon. Likewise, any indication herein and/or in the claims regarding a given layer being located "over and above" (or some other equivalent phrase) the substrate under consideration shall signify a situation where the layer of concern is positioned over (e.g. on top of) the substrate either directly with no intervening layers being present or with one or more intervening layers therebetween. In other words, the foregoing phrase (e.g. "over and above" and equivalents thereto) as it applies to a given layer shall be construed to involve a situation where such layer is somehow above the substrate (e.g. outermost as previously defined relative to the substrate) whether or not any intervening layers are located between the substrate and the layer of concern.

Furthermore, any indication that the ink-receiving layer(s) (or other layers set forth herein) are somehow "supported" by the substrate under consideration (whether coated or uncoated as outlined below) shall signify a situation where the layer(s) in question reside on the substrate and are directly attached thereto as previously defined or indirectly attached thereto with one or more layers therebetween. In such a situation, the layer(s) of concern rely on the substrate for structural support whether or not there are any intervening layers therebetween.

Any and all recitations of structures, layers, materials, and components in the singular throughout the Claims, Summary, and Detailed Description sections shall also be construed to encompass a plurality of such items unless otherwise explicitly noted herein. Likewise, employment of the phrase "at least one" shall be construed in a conventional fashion to involve "one or more" of the listed items, with the term "at least about" being defined to encompass the listed numerical value and values in excess thereof. Use of the word "about" in connection with any numerical terms or ranges recited herein shall be construed to offer at least some latitude both above and below the listed parameter(s) with the magnitude thereof being construed in accordance with current and applicable legal decisions pertaining to this terminology.

As previously indicated, highly effective and versatile print media materials designed to receive ink materials thereon for the generation of clear, stable, water-fast, and distinct printed images are provided. These media materials are again characterized by uniform surface/gloss characteristics, a desirable degree of ink-coalescence control ("non-graininess"), and a high level of image stability from a humid-fastness and light-fastness standpoint as previously defined. Many different ink delivery systems can be employed to generate the printed images of interest on the claimed media products without limitation although the use of devices that incorporate thermal inkjet technology are preferred. Printing units using thermal inkjet technology again basically involve an apparatus which includes at least one ink reservoir chamber in fluid communication with a substrate (preferably made of silicon (Si) and/or other comparable materials) having a plurality of thin-film heating resistors thereon. The substrate and resistors are maintained within a structure that is conventionally characterized as a "printhead". Selective activation of the resistors causes thermal excitation of the ink materials stored inside the reservoir chamber and expulsion thereof from the printhead. Representative thermal inkjet systems of both the "on-board" and "off-axis" types (all of which are applicable to the claimed print media products) are again discussed in, for example, U.S. Pat. Nos. 4,771,295, 5,278,584, and 5,975,686.

Furthermore, while the print media products outlined in this section will be discussed with primary reference to thermal inkjet technology, it shall be understood that they may be employed in connection with different ink delivery systems and methods including but not limited to piezoelectric drop devices of the variety disclosed in U.S. Pat. No. 4,329,698 and dot matrix units of the type described in U.S. Pat. No. 4,749,291, as well as other comparable and diverse systems designed to deliver ink using one or more ink delivery components/assemblies. In this regard, the claimed print media products and methods shall not be considered "print method-specific". As an additional point of information, exemplary printer units which are suitable for use with the print media products of the present invention include but are not limited to those manufactured and sold by the Hewlett-Packard Company of Palo Alto, Calif. (USA) under the following product designations: "DESKJET®" 400C, 500C, 540C, 660C, 693C, 820C, 850C, 870C, 895CSE, 970CSE, 990CXI, 1200C, and 1600C, as well as systems sold by the Hewlett-Packard Company under the "DESIGNJET®" trademark (5000 series), and others.

Furthermore, the claimed invention (namely, the novel print media products and production methods associated therewith) are not "ink-specific" and may be used in connection with a wide variety of inks, dyes, pigments, liquid and solid toner compositions, sublimation dyes, colorants, stains, waxes, and the like without restriction. For example, representative ink compositions that can be employed in connection with the print media materials of this invention include but are not limited to those discussed in U.S. Pat. Nos. 4,963,189 and 5,185,034 (both incorporated herein by reference in their entireties) which represent only a small fraction of the ink compositions and colorant formulations that can be used with the claimed print media products.

At this point, a detailed discussion of the claimed print media products will now be presented with the understanding that the data set forth below shall be considered representative in nature, with the current invention being defined by the claims presented herein. It shall also be understood that the recitation of specific materials and embodiments which are identified as "preferred" constitute novel developments that provide optimum and unexpectedly effective results. Furthermore, all of the definitions, terminology, and other information recited above in the Background and Summary sections are applicable to and incorporated by reference in the current Detailed Description section.

Figure 2:
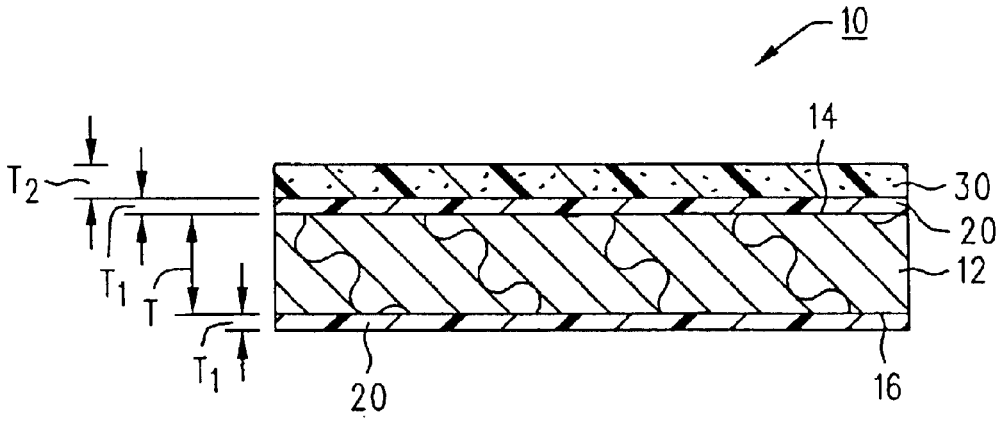
FIG. 2 is a schematically-illustrated and enlarged partial cross-sectional view of a completed print media product produced in accordance with a primary embodiment illustrating the material layers and thicknesses associated therewith.

In accordance with FIGS. 1 and 2, a preferred print media product in completed form for use as an image-receiving sheet is schematically illustrated at reference number 10. The methods, materials, process steps, and other data associated with print media product 10 will now be discussed which constitutes a representative and non-limiting preferred embodiment designed to produce excellent results. As illustrated in FIGS. 1–2, a substrate 12 (also known as a "support structure", "support", or "base member" with all of such terms being considered equivalent from a structural and functional standpoint) is initially provided. The other layers and materials associated with the print media product 10 reside on this structure and are supported thereby. The substrate 12 is optimally fabricated in the form of a flexible sheet comprising an upper surface 14 (also characterized herein as a "first side" or "top surface") and a lower surface 16 (also characterized herein as a "second side" or "bottom surface"), with both of the surfaces/sides 14, 16 being substantially planar and having a uniform surface texture in the representative embodiment of FIG. 2. Likewise, the substrate 12 may be configured in roll, web, strip, film, or sheet form with transparent, semi-transparent, or opaque characteristics as needed and desired.

In a preferred version of the print media product 10 (which optimally involves the use of cellulosic (e.g. cellulose-containing) paper in sheet form as the substrate 12), the substrate 12 will have an exemplary and non-limiting uniform thickness "T" (FIG. 2) along its entire length of about 0.025–0.25 mm (optimum=about 0.05–0.20 mm), with these ranges also being applicable to all of the other substrate materials discussed herein. Other construction compositions that can be employed in connection with the substrate 12 aside from paper include but are not limited to paperboard, wood, cloth, non-woven fabric, felt, synthetic (e.g. non-cellulosic) paper, ceramic compositions (optimally unglazed), glass or glass-containing products, metals (e.g. in foil form made from, for instance, aluminum (Al), silver (Ag), tin (Sn), copper (Cu), mixtures thereof, and others as determined by the intended use of the completed print media product 10), and composites/mixtures of such materials. Likewise, various organic polymer compositions can be employed to form the substrate 12 including, without limitation, those fabricated from polyethylene, polystyrene, polyethylene terephthalate, polycarbonate resins, polytetrafluoroethylene (also known as "Teflon®"), polyimide, polypropylene, cellulose acetate, poly(vinyl chloride), and mixtures thereof.

However, as previously stated, commercially-available paper is preferred in connection with the substrate 12, with the present invention not being restricted to any particular type of paper. In an exemplary and non-limiting embodiment designed to offer optimum results (including a high degree of strength, flexibility, economy, and durability), cellulosic paper materials can be employed wherein at least one of the upper and lower surfaces (e.g. first and second sides) 14, 16 thereof (preferably the upper surface 14 which faces the various layers in the print media product 10 or both surfaces 14,16) are coated with a selected coating material or formulation that is substantially non-porous, non-absorbent, and ink-impermeable. In the representative embodiment illustrated schematically in FIG. 2, a coating layer 20 is provided on the upper and lower surfaces 14, 16 of the substrate 12 (e.g. made of paper as previously noted). The coating layer 20 optimally has a uniform thickness "$T_1$" (FIG. 2) of about 1–40 $\mu$m (optimum=about 1–20 $\mu$m), with this range being applicable to all of the coating materials set forth herein and subject to change as needed and desired. The coating layer 20 may be produced from a number of compositions without limitation, with such compositions (and the use of a coating layer 20 in general) being selected in accordance with numerous factors including the type of ink being delivered, the printing system In which the print media product 10 will be used, and the like. If a non-porous, non-ink-absorbent coating layer 20 is desired, a representative material suitable for this purpose would involve polyethylene although other compositions can be employed to achieve this goal including various organic polymers such as polystyrene, polyethylene terephthalate, polycarbonate resins, polytetrafluoroethylene (Teflon®), polyimide, polypropylene, cellulose acetate, poly(vinyl chloride), and mixtures thereof.

Alternatively, the coating layer 20 (irrespective of whether it is placed on either or both surfaces 14, 16 of the substrate 12) may involve a wide variety of other ingredients in order to form a more absorbent layer of material. These various ingredients include but are not limited to one or more pigments, binders, fillers, and other "supplemental ingredients" such as defoamer compositions (e.g. surfactants), biocides, hardeners, UV/light stabilizers, buffers, slip agents, pH control compounds, preservatives (e.g. antioxidants), lactic acid, and the like. Of primary concern in connection with such a coating layer 20 is the use of at least one or more pigment compositions in combination with at least one or more binders. The present invention shall not be restricted to any particular compositions in connection with this type of coating layer 20. In this regard, many different materials, material quantities, and formulations are possible. Exemplary pigments which can be employed in connection with the coating layer 20 (should pigments be desired therein) include but are not limited to boehmite, pseudo-boehmite, silica (in precipitated, colloidal, gel, sol, and/or fumed form), cationic-modified silica (e.g. alumina-treated silica in an exemplary and non-limiting embodiment), cationic polymeric binder-treated silica, magnesium oxide, polyethylene beads, polystyrene beads, magnesium carbonate, calcium carbonate, barium sulfate, clay, titanium dioxide, gypsum, mixtures thereof, and others without limitation. Likewise, at least some of the pigment compositions listed above or others may also be employed within the main ink-receiving layer of the claimed invention which will be more fully explained below.

A representative and non-limiting quantity value associated with the use of one or more pigment compositions in the coating layer 20 is about 20–90% by weight (optimum= about 40–70% by weight), with these numerical parameters being subject to change as needed and desired. Likewise, the above-listed values will involve the total (e.g. collective) amount of pigment composition(s) being used whether a single pigment is employed or multiple pigments are used in combination as previously stated.

Regarding the use of one or more binder materials in the coating layer 20, such compositions may include (without limitation) polyvinyl alcohol and derivatives thereof (e.g. carboxylated polyvinyl alcohol, sulfonated polyvinyl alcohol, acetoacetylated polyvinyl alcohol, and mixtures thereof), starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl pyrrolidone-vinyl acetate) copolymer, a poly(vinyl acetate-ethylene) copolymer, a poly(vinyl alcohol-ethylene oxide) copolymer, mixtures thereof, and others without restriction. In this regard, the coating layer 20 shall not be limited to any given binders with many different variants being possible. At least some of the binder compositions listed above or others may also be employed within the main ink-receiving layer of the claimed invention which will be more fully explained below.

A representative and non-limiting quantity value associated with the use of one or more binder materials in the coating layer 20 is about 10–80% by weight (optimum= about 10–40% by weight), with these numerical parameters being subject to change as needed and desired. The foregoing values will again involve the total (e.g. collective) amount of binder(s) being used whether a single binder is employed or multiple binders are used in combination as previously stated. Should any of the other components recited above (namely, the "supplemental ingredients") be employed within this particular embodiment of the coating layer 20 (with the use of such supplemental ingredients being considered "optional"), the amount thereof may be varied as needed and desired. In this regard, the present invention shall not be limited to any particular numerical values in connection with the coating layer 20, with the quantity of binders and/or pigments in the layer 20 (if used) being reduced proportionately relative to the amount of any supplemental ingredients that may be added.

While the use of coating layer 20 on either or both surfaces 14, 16 of the substrate 12 can impart added strength and image clarity to the final print media product 10 (or other benefits depending on the ingredients being employed), the coating layer 20 can be eliminated entirely on either or both surfaces 14, 16 of the substrate 12 if desired as again determined by routine preliminary testing. The claimed print media products shall not be restricted to any given type of coating layer 20 or the use thereof in general.

For the purposes of this invention, if a coated substrate 12 is employed as discussed above, the coating layer 20 shall be construed and defined as part of the substrate 12, with the representative thickness value "T" associated with the substrate 12 being suitably adjusted in this regard. Such a characterization is appropriate since coated paper materials including those discussed herein are traditionally available in pre-manufactured form from various paper suppliers and producers. For example purposes, a representative paper substrate 12 covered on both surfaces/sides 14, 16 with a coating layer 20 made of polyethylene is commercially available in completed form from Felix Schoeller Technical Papers, Inc. of Pulaski, N.Y. (USA). Likewise, an exemplary paper substrate 12 which is coated on both surfaces/sides 14, 16 with a coating layer 20 comprised of a proprietary blend of at least one pigment composition and at least one binder is commercially available from Westvaco Corporation of New York, N.Y. (USA).

With continued reference to FIGS. 1–2, an ink-receiving layer 30 is preferably applied (e.g. operatively attached or affixed) to the coating layer 20 on the upper surface 14 of the substrate 12 so that the ink-receiving layer 30 is positioned over and above the substrate 12 as illustrated. In this manner, the ink-receiving layer 30 is supported by the substrate 12, with the term "supported" being defined above. If the coating layer 20 was not employed on the substrate 12, the ink-receiving layer 30 in the embodiment of FIG. 2 would simply be placed on the upper surface 14. The ink-receiving layer 30 in the embodiment of FIG. 2 is designed and configured for use as the "top", "uppermost", or "outermost" layer of material associated with the print media product 10 as previously defined. Likewise, in the present embodiment, the ink-receiving layer 30 is optimally (but not necessarily) configured for direct attachment to the coating layer 20/upper surface 14 of the substrate 12. As noted above, the term "direct attachment" is defined to involve affixation of the ink-receiving layer 30 to the coating layer 20/upper surface 14 of the substrate 12 without any intervening material layers therebetween in order to minimize the number of material layers employed in the final print media product 10. However, it shall be understood that one or more intervening material layers can be used between the ink-receiving layer 30 and the substrate 12 (whether coated or uncoated) if needed and desired as determined by routine preliminary research. These intervening material layers can be made from a wide variety of different compositions without restriction as outlined in greater detail below relative to the embodiment of FIG. 3.

Furthermore, it shall be understood that the ink-receiving layer 30 is again designated herein as being "supported" by the substrate 12 (whether coated or uncoated with the coating layer 20). This characterization emphasizes the fact that the substrate 12 is employed as a structural component on which the ink-receiving layer 30 can reside (whether directly on the substrate 12 or on any layers operatively attached thereto or associated therewith including the coating layer 20 or other layers as outlined below in the products of FIGS. 3 and 4).

All of the embodiments described herein and shown in each of the drawing figures (FIGS. 1–4) are basically "one-sided" with the ink-receiving layer 30 and any layer(s) thereunder or thereover being located on only one side of the substrate 12 (e.g. the coating layer 20/upper surface 14). Nonetheless, other print media products encompassed within this invention may involve placement of the foregoing layers on either or both sides of the substrate 12 (coated or uncoated) if needed and desired without limitation. Taking this information into account, the use of "on the substrate", "over and above the substrate", "operatively attached to the substrate", "supported" by the substrate, "affixed to the substrate", and the like when describing the layering arrangements discussed herein shall encompass both "one-sided" and "dual-sided" media sheets. This language will specifically involve situations in which the subject layers are placed on either or both sides of the substrate 12. However, if a substrate 12 is employed which includes a coating layer 20 thereon as discussed herein, the ink-receiving layer 30 and any layer(s) thereunder or thereover are optimally (but not necessarily) placed on the side or sides of the substrate 12 that are coated with the layer 20 irrespective of the materials employed within the layers 20, 30.

From a functional standpoint, the ink-receiving layer 30 is designed to provide a high degree of "capacity" (e.g. ink-retention capability) in connection with the print media product 10, to facilitate rapid drying of the printed, image-containing print media product 10, to generate images that are highly humid-fast and light-fast as defined above, to provide an excellent degree of ink-coalescence control (which avoids excessive "graininess" of the completed image), and to create a print media product 10 with a smooth/even surface having a desired degree of gloss (preferably of a "glossy" or "semi-gloss" character). Furthermore, the ink-receiving layer 30 should be able to generate humid-fast and smear-fast images using a wide variety of inks, colorant materials, pigments, dye dispersions, sublimation dyes, liquid or solid toner formulations, powders, stains, waxes, and other comparable chromatic (e.g. colored) or achromatic (black or white) compositions without limitation.

In an exemplary and non-restrictive embodiment, the ink-receiving layer 30 will have a representative and non-limiting uniform thickness "$T_2$" (FIG. 2) along its entire length of about 1–50 $\mu$m (optimum=about 20–30 $\mu$m) although this range may be varied as necessary. From a material-content standpoint, the ink-receiving layer 30 in this embodiment (with other embodiments also being possible as noted below) includes some very special ingredient combinations which are designed to facilitate the attainment of numerous important goals in a novel and effective manner including those recited above. Of particular interest is the ability of the ink-receiving layer 30 to employ gelatin (which is a versatile, economical, and effective binder compound) while avoiding the excessive ink-coalescence and image "graininess" that often occurs when gelatin is used as the sole or predominant binder. As will be outlined further below, the claimed invention encompasses a very special binder blend and permits gelatin to be employed (which has many beneficial attributes as previously discussed), yet avoids the "graininess" situation discussed above. Specifically, by combining the gelatin with certain carefully-selected additional binder compounds, a specialized and novel "binder system" or "binder blend" is created which offers the benefits of gelatin while effectively controlling ink-coalescence (and the "graininess" associated therewith). Further information involving this special binder system will be now be discussed in detail.

As previously stated, the ink-receiving layer 30 will employ a plurality (e.g. at least one or more) of binder compositions (also characterized as simply "binders"). It has been determined that the use of a special "binder blend" (also referenced herein as a "binder mixture", "binder combination", and the like) offers certain important benefits including those listed above. It should likewise be noted that the term "binder" as recited throughout this description shall generally and traditionally involve compositions which have the ability to chemically, physically, electrostatically, or otherwise retain one or more materials together in a given formulation or structure in order to provide mechanical strength, cohesiveness, and the like. Furthermore, the word "copolymer" as employed herein shall be construed in a traditional fashion to encompass a polymer composition which is the product of two or more different compounds or groups which are used to form the polymeric structure/backbone.

Regarding the binder blend mentioned above, the following materials are considered to be preferred, optimum, and (in combination) capable of ensuring that the foregoing benefits are achieved (including the ability to effectively control ink-coalescence problems, superior humid-fastness, a high degree of image stability, and the like):

1. "First Binder Composition" (or just "First Binder"): Gelatin —Gelatin basically consists of a product which is derived from animal connective tissues. In particular, it is obtained by the treatment of these tissues with boiling water and/or acid materials wherein a hydrolysis reaction occurs in order to yield the final gelatin product. From a chemical standpoint, gelatin is characterized as a protein compound which contains the amino acids hydroxyproline, proline, and glycine. Gelatin molecules are fairly large in size with a typical molecular weight as high as hundreds of thousands of daltons. Aside from its many uses in the food, cosmetic, and pharmaceutical industries, it has been determined that gelatin is particularly useful for the production of ink-receiving layers employed in print media products of the type being discussed herein. Specifically, gelatin is characterized by a high fluid absorption capacity which is especially desirable when ink materials are being delivered to a chosen print media product. In accordance with its high absorption capacity in a print media sheet, this characteristic will result in many benefits including but not limited to rapid drying times, the ability to retain substantial amounts of ink in order to efficiently generate large-scale multi-color images, the avoidance of color bleed (namely, the undesired blending of multi-colored inks into each other during the printing process), as well as a high level of stability when the image is exposed to light and moisture. The fluid absorption capacity of gelatin is generally demonstrated by the fact that gelatin, when placed in contact with water, is typically able to absorb about 5–10 times its own weight in water. Additional benefits provided by the use of gelatin in the ink-receiving layer 30 include but are not restricted to improved image permanence, better humid-fastness, and good light-fastness.

Accordingly, gelatin offers a number of important attributes when employed in the ink-receiving layer(s) of a print media product. The claimed invention shall not be restricted to any particular types, grades, or varieties of gelatin with a number of different gelatin compositions or derivatives being suitable for use herein. A representative and preferred gelatin material that is appropriate for use in the ink-receiving layer 30 (and any of the additional layers mentioned below if desired) will involve a composition that is commercially available from DGF Stoess AG of Eberbach, Germany. This material is derived from pig skin and is characterized by a high isoelectric point of greater than about 8 which is desirable in the ink-receiving layer 30 because, for example, it tends to promote an improved interaction between the ink-receiving layer 30 and the colorants being delivered thereto. The term "isoelectric point" is generally defined to involve the pH value at which the particles in a colloidal suspension (such as gelatin) do not move when exposed to an electric field. Regarding the above-listed commercial product, it is further characterized by favorable viscosity and bloom levels, as well as other related parameters. However, it should again be noted that the commercial gelatin product discussed above is being recited for example purposes only and shall not be considered limiting in any respect.

Notwithstanding the benefits offered by gelatin in print media products, it has also been observed that ink-receiving layers which incorporate gelatin as the sole or predominant (e.g. majority) binder may exhibit an undesirably high level of ink-coalescence which generates printed images having an unacceptable level of "graininess". As a result, the images generated on the print media sheet will have a "rough" and "granular" appearance which is particularly disadvantageous when "photo-quality" images are desired. This situation can result when gelatin is used as the sole or predominant binder because, for example, its swellability can become substantially reduced under cold and/or dry environmental conditions which will often lead to excessive "graininess". It has been discovered in accordance with the present invention that these difficulties can be substantially eliminated while preserving the benefits associated with the use of a gelatin-based binder by the employment of various "co-binders" with gelatin to produce a distinctive binder blend. This binder blend will not only contain gelatin, but will also include at least two specially-selected additional binders which effectively control the ink-coalescence problems discussed above and thereby avoid the formation of unacceptably "grainy" images. These additional binders will now be reviewed in considerable detail.

2. "Second Binder Composition" (or just "Second Binder"): A poly(vinyl alcohol-ethylene oxide) copolymer —Regarding the use of a poly(vinyl alcohol-ethylene oxide) copolymer as the Second Binder in the ink-receiving layer 30 (or in any other layers associated with the print media product 10), this material has the following basic chemical/polymeric structure:

$$(\text{—}CH_2CHOH\text{—})_x(\text{—}OCH_2CH_2\text{—})_y \quad (1)$$

(wherein x=about 1000–8000, and y=about 10–500 in a representative, preferred, and non-limiting formulation).

It should be noted that the above-listed "x" and "y" values in Formula (1) and the other formulae recited herein are presented for example purposes only and constitute representative/preferred embodiments in a non-limiting fashion. These numbers are subject to change if needed and desired in accordance with routine preliminary testing. An exemplary poly(vinyl alcohol-ethylene oxide) copolymer which may be employed for the purposes listed herein (namely, within ink-receiving layer 30 as the Second Binder or in other layers) is commercially available from, for example, Nippon Gohsei of Osaka, Japan under the product designation "WO-320".

It should also be noted that the term "poly(vinyl alcohol-ethylene oxide) copolymer" may actually be characterized in two different ways. The first characterization of interest involves the structure listed above in connection with Formula (1). This structure contains polyvinyl alcohol groups that are generally designated herein as being "fully hydrolyzed" which will now be explained in detail. The production of polyvinyl alcohol (which can be used as a "stand-alone" ingredient or as an integral part of various polymers including the poly(vinyl alcohol-ethylene oxide) copolymer discussed above) typically involves the hydrolysis of poly (vinyl acetate) under varied conditions. During this production process as discussed above, varying degrees of "hydrolysis" can occur whereby, in certain situations, residual acetate groups (—$OCOCH_3$) are left within the polyvinyl alcohol backbone depending on a wide variety of production and reaction parameters. Compositions of the type associated with Formula (1) as listed above are typically characterized as being "fully hydrolyzed" in that they contain only a minimal quantity of residual acetate groups in the molecule. This characterization is set forth in, for example, U.S. Pat. No. 5,880,196 which is incorporated in this discussion by reference in its entirety. For example, a polyvinyl alcohol molecule is traditionally considered to be "fully hydrolyzed" if less than about 1.5 mole percent acetate groups are left on the molecule. Accordingly, the term "poly(vinyl alcohol-ethylene oxide) copolymer" as used and claimed herein shall encompass the "fully hydrolyzed" composition described above and illustrated in Formula (1).

In addition, the term "poly(vinyl alcohol-ethylene oxide) copolymer" shall also be defined and interpreted herein and for the purposes of this invention to encompass structures wherein the polyvinyl alcohol component thereof is considered to be "partially hydrolyzed". Partially hydrolyzed polyvinyl alcohol is typically defined to involve polyvinyl alcohol molecules wherein about 1.5 to as much as about 20 mole percent or more acetate groups are left on the molecule. Again, the extent of hydrolysis will depend on a wide variety of production parameters. The structure shown in Formula (2) below represents a poly(vinyl alcohol-ethylene oxide) copolymer which contains "partially hydrolyzed" polyvinyl alcohol groups:

$$(—CH_2CHOH—)_x(—CH_2CHOCOCH_3—)_y(—OCH_2CH_2—)_z \quad (2)$$

(wherein x=about 1000–8000, y=about 100–800, and z=about 10–500 in a representative, preferred, and non-limiting formulation).

It should be noted that the above-listed "x", "y", and "z" values in Formula (2) and the other formulae recited herein are again presented for example purposes only and constitute representative/preferred embodiments in a non-limiting fashion. These numbers are subject to change if needed and desired in accordance with routine preliminary testing. Furthermore, the composition of Formula (2) is also known and designated herein as a "poly(vinyl alcohol-vinyl acetate-ethylene oxide) copolymer".

In summary, it should be understood that the term poly (vinyl alcohol-ethylene oxide) copolymer shall be construed to encompass both of the formulae listed above (namely, Formulae (1) and (2)), as will as combinations thereof in any proportions, ratios, and the like without restriction. It should likewise be recognized that the foregoing definition corresponds with the traditional understanding and interpretation of "poly(vinyl alcohol-ethylene oxide) copolymer" which is known and used by those skilled in the art to which this invention pertains.

The employment of a poly(vinyl alcohol-ethylene oxide) copolymer in the ink-receiving layer 30 provides a number of functional benefits including but not limited to the control of ink-coalescence (and prevention of excessive "graininess" notwithstanding the employment of gelatin as the First Binder), improved humid-fastness, a high level of light-fastness, and a generally superior degree of image quality and long-term stability. These benefits are achieved (with particular reference to ink-coalescence control) in accordance with the ability of poly(vinyl alcohol-ethylene oxide) copolymers to attain a better compatibility between the ink-receiving layer 30 and colorants in the ink being delivered. Some additional chemical and functional characteristics of the above-mentioned poly(vinyl alcohol-ethylene oxide) copolymer that are of interest include but are not limited to beneficial elasticity levels provided by this material.

3. "Third Binder Composition" (or just "Third Binder"): A poly((styrene)-(n-butyl acrylate)-(methyl methacrylate)-(2-(tert-butylamino) ethyl methacrylate)) copolymer. In particular, the foregoing structure involves a 4-component copolymer as noted above. Regarding the use of a poly ((styrene)-(n-butyl acrylate)-(methyl methacrylate)-(2-(tert-butylamino) ethyl methacrylate)) copolymer as the Third Binder in the ink-receiving layer 30 (or in any other layers associated with the print media product 10), this material has the following basic chemical/polymeric structure (with such material and the present characterization of it being generally discussed in U.S. Pat. No. 5,880,196 which is again incorporated herein by reference):

$$(—CH_2CH(Ph))_x(—CH_2CHCOO(Bu)—)_y(—CH_2CCH_3COOCH_3—)_z(—CH_2CCH_3COOCH_2CH_2NH(t—Bu)—)_m \quad (3)$$

(wherein x=about 10–80, y=about 40–100, z=about 100–300, m=20–200, "Ph"=a benzene ring (e.g.—$C_6H_5$), "Bu"=an n-butyl group (e.g.—$CH_2CH_2CH_2CH_3$), and "t-Bu"=a t-butyl group (e.g.—$C(CH_3)_3$) in a representative, preferred, and non-limiting formulation.)

Again, the above-listed "x", "y", and "z" values in this formula and the other formulae recited herein are presented for example purposes only and constitute representative/preferred embodiments in a non-limiting fashion. These numbers are subject to change if needed and desired in accordance with routine preliminary testing.

An exemplary poly((styrene)-(n-butyl acrylate)-(methyl methacrylate)-(2-(tert-butylamino) ethyl methacrylate)) copolymer which may be employed for the purposes listed herein (namely, within the ink-receiving layer 30 as the Third Binder or in other layers) is commercially available from, for instance, PPG Industries, Inc. of Pittsburgh, Pa. (USA).

The employment of a poly((styrene)-(n-butyl acrylate)-(methyl methacrylate)-(2-(tert-butylamino) ethyl methacrylate)) copolymer in the ink-receiving layer 30 provides a number of functional benefits including but not limited to the control of ink-coalescence (and prevention of excessive "graininess" notwithstanding the selection of gelatin as the First Binder), improved humid-fastness, a high level of light-fastness, and a generally superior degree of image quality and long-term stability. These benefits are achieved (with particular reference to ink-coalescence control) in accordance with the ability of poly((styrene)-(n-butyl acrylate)-(methyl methacrylate)-(2-(tert-butylamino) ethyl methacrylate)) copolymers to promote improved chemical interactions between the ink-receiving layer 30 and the colorants in the inks being delivered. Some additional chemical and functional characteristics of the above-mentioned poly((styrene)-(n-butyl acrylate)-(methyl methacrylate)-(2-(tert-butylamino) ethyl methacrylate)) copolymer that are of interest include but are not limited to the ability of this material to provide reduced "dry-to-touch" times, as well as a heightened degree of smear-fastness.

In a preferred and non-limiting embodiment designed to provide effective results, the ink-receiving layer 30 will contain therein: (A) about 10–30% by weight (optimum= about 15–25% by weight) First Binder (gelatin); (B) about 30–55% by weight (optimum=about 35–50% by weight) Second Binder (a poly(vinyl alcohol-polyethylene oxide) copolymer as previously defined); and (C) about 10–30% by weight (optimum=about 15–25% by weight) Third Binder (a poly((styrene)-(n-butyl acrylate)-(methyl methacrylate)-(2-(tert-butylamino) ethyl methacrylate)) copolymer. However, it should again be understood that the above-mentioned numerical values are being provided herein for example purposes only as optimized embodiments and shall not limit the invention in any respect. Accordingly, this invention shall not be restricted to any particular numerical quantities regarding any of the ingredients set forth herein which may be varied as needed and desired in accordance with routine preliminary pilot experimentation. Furthermore, unless expressly stated otherwise, all percentage figures concerning the material content of the various layers discussed in the Claims, Summary, and Detailed Description sections shall involve "dry weight", namely, the weight of the chosen ingredient(s) in the dried material layer(s) or structure(s) of interest.

At this point, it should again be emphasized that the foregoing combination of ingredients which constitutes the special binder blend discussed above enables gelatin to be employed while simultaneously controlling the ink-coalescence problems (and "graininess") which can result when gelatin is used as the sole or predominant binder. A combination of the three binders recited above involves a unique formulation which represents a significant advance in print media technology. This advance is characterized by a substantial improvement in image quality compared with formulations containing gelatin as the sole or predominant binder. It should be understood that the claimed binder blend may involve the only materials which are present in the ink-receiving layer 30 (wherein the layer 30 is "binder only") or, in the alternative, the binder blend can be combined with one or more other ingredients without limitation. At least some of these other ingredients will now be discussed with the understanding that the claimed invention shall not be restricted to the combination of any ingredients with the foregoing binder blend (or amounts thereof) unless otherwise explicitly stated herein.

Regarding the use of additional materials in combination with the binder blend, a variety of different compositions can be employed for this purpose. These additional materials (also characterized herein as "additional ingredients" "supplemental materials", "supplemental ingredients", "auxiliary materials", "auxiliary ingredients", and the like without limitation) will now be discussed. The claimed invention shall not be restricted to any particular additional materials, with the compositions recited below being provided for example purposes only in a non-limiting fashion.

Various other binders (one or more) can be used in combination with or as part of the above-mentioned binder blend. As previously noted, the binder blend in its most basic form comprises the First, Second, and Third Binders identified above which are also designated herein as the "main" binders. Specifically, at least one alternative (e.g. optional) organic or inorganic binder material can be added to the main binders without limitation. This alternative binder material generally involves at least one additional binder which is different from the First Binder, Second Binder, and Third Binder. The present invention shall not be restricted to any given additional binder compositions, quantities thereof, or number of such binders which may be determined by routine preliminary analysis. Representative and non-limiting examples of additional binders which can be employed in all embodiments of the ink-receiving layer 30 along with the main binders (and/or in other layers in the print media product 10) include without limitation: starch, SBR latex, alginates, carboxycellulose materials (for example, methylhydroxypropyl cellulose, ethylhydroxypropyl cellulose, and the like), polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), mixtures thereof, and others without restriction.

Representative polyurethanes that are suitable for use as additional binder compositions alone or combined with the other binder materials expressed herein include but are not limited to the sub-class of compounds which would involve water-soluble or water-dispersible polyurethane polymers, water-soluble or water-dispersible modified polyurethane resin dispersions, and mixtures thereof. Of particular interest is the employment of at least one modified polyurethane resin dispersion. The term "modified polyurethane resin dispersion" shall be generally defined herein to encompass polyurethane polymers having hydrophobic groups associated therewith, wherein such materials are water-dispersible. While many different modified polyurethane resin dispersions are commercially available from numerous sources (and are typically proprietary in nature), a modified polyurethane resin dispersion that is appropriate for use as an additional binder composition involves a product sold by Dainippon Ink and Chemicals/Dainippon International (USA), Inc. of Fort Lee, N.J. (USA) under the product designation "PATELACOL IJ-30". Further general information concerning this type of material (with particular reference to polyurethane dispersions/emulsions) is provided in Japanese Patent Publication No. 10-181189 which is incorporated herein by reference in its entirety. However, other polyurethane-based materials shall also be appropriate for use as additional binders within the ink-receiving layer 30 (or other layers), with the above-listed composition being provided for example purposes only.

Regarding the employment of polyamide resins as additional binder compositions, the following chemicals can be encompassed within this class of compounds without limitation: acrylic modified polyamides, acrylic polyamide copolymers, methacrylic modified polyamides, cationic polyamides, polyquaternary ammonium polyamides, poly (styrene-acrylic) copolymers, epichlorohydrin-containing polyamides, and mixtures thereof. One composition of particular interest within this group is an epichlorohydrin-containing polyamide. The term "epichlorohydrin-containing polyamide" shall be generally defined to involve an epichlorohydrin group-containing polyamide formulation, with this composition having the following basic structural/chemical formula:

$$(C_6H_{10}O_4.C_4H_{13}N_3.C_3H_5ClO)_x \quad (4)$$

(wherein x=about 1–1000 in a representative, preferred, and non-limiting formulation).

Epichlorohydrin-containing polyamides are commercially available from, for example, Georgia Pacific Resins, Inc. of Crossett, Ark. (USA) under the product designation "AMRES 8855".

Also appropriate for use as an additional binder composition is polyvinyl alcohol. The basic structural formula for polyvinyl alcohol is as follows:

$$(\text{—}CH_2CHOH\text{—})_x \quad (5)$$

(wherein x=about 1–3000 in a representative, non-limiting, and preferred embodiment).

This material is commercially available from numerous sources including but not limited to Nippon Gohsei of Osaka, Japan under the product designation "GOHSENOL NH-26", as well as Air Products and Chemicals, Inc. of Allentown, Pa. (USA) under the product designation/trademark "Airvol® 523". Exemplary and non-limiting derivatives of polyvinyl alcohol which shall be encompassed within the term "polyvinyl alcohol" as used herein include but are not limited to unsubstituted polyvinyl alcohol as illustrated and discussed above, carboxylated polyvinyl alcohol, sulfonated polyvinyl alcohol, acetoacetylated polyvinyl alcohol, and mixtures thereof. Acetoacetylated polyvinyl alcohol has the following basic structural formula:

$$(\text{—}CH_2CHOH\text{—})_x(CH_2CHOCOCH_2COCH_3\text{—})_y \quad (6)$$

(wherein x=about 1–3000 and y=about 1–100 in a representative, non-limiting, and preferred embodiment).

Acetoacetylated polyvinyl alcohol is commercially available from numerous sources including, for example, Nippon Gohsei of Osaka, Japan under the product designation "GOHSEFIMER Z 200". However, regarding the use of polyvinyl alcohol as an additional binder composition "straight" (e.g. unsubstituted) polyvinyl alcohol is preferred. Likewise, use of the term "polyvinyl alcohol" as stated herein shall encompass polyvinyl alcohols which are "fully hydrolyzed" or "partially hydrolyzed" as previously discussed in connection with the polyvinyl alcohol used to manufacture the poly(vinyl alcohol-ethylene oxide) copolymer. Accordingly, all of the information provided above concerning the full and partial hydrolysis of polyvinyl alcohol is incorporated in the current discussion by reference. During the production process associated with polyvinyl alcohol as previously noted, varying degrees of "hydrolysis" can occur whereby, in certain situations, residual acetate groups ($—OCOCH_3$) are left within the polyvinyl alcohol backbone depending on a wide variety of production and reaction parameters. For example, a polyvinyl alcohol molecule is traditionally considered to be "fully hydrolyzed" if less than about 1.5 mole percent acetate groups are left on the molecule. This characterization is discussed in, for instance, U.S. Pat. No. 5,880,196 as previously noted. Accordingly, the term "polyvinyl alcohol" as used herein shall include the "fully hydrolyzed" composition described above.

In addition, "polyvinyl alcohol" shall also be defined and interpreted herein to encompass structures wherein the polyvinyl alcohol component thereof is considered to be "partially hydrolyzed". Partially hydrolyzed polyvinyl alcohol is typically defined to involve polyvinyl alcohol molecules wherein about 1.5 to as much as about 20 mole percent or more acetate groups are left on the molecule. Again, the extent of hydrolysis will depend on a wide variety of production parameters. It has been determined that, while any of the aforementioned polyvinyl alcohol compositions within the foregoing broad definition can be used as an additional binder material, polyvinyl alcohols having a hydrolysis level of about 88–99% will provide effective results.

Depending on the ultimate applications and uses for which the print media product 10 is intended, the employment of polyvinyl alcohol as an additional binder can offer a number of benefits in the ink-receiving layer 30 when combined with the main binders discussed above including but not limited to the ability of polyvinyl alcohol to provide a high degree of binding strength, color accuracy, and bleed control, as well as improved color gamut.

Another additional binder composition of interest will involve a poly(vinyl acetate-ethylene) copolymer. The basic structural formula for this poly(vinyl acetate-ethylene) copolymer is as follows:

$$(—CH_2CHOCOCH_3—)_x(—CH_2CH_2—)_y \quad (7)$$

(wherein x=about 250–32,000 and y=about 800–100,000 in a representative, non-limiting, and preferred embodiment).

This composition is commercially available from numerous sources including but not limited to Air Products and Chemicals, Inc. of Allentown, Pa. (USA) under the product designation/trademark "Airflex® 315". The particular benefits provided by the use of a poly(vinyl acetate-ethylene) copolymer in the ink-receiving layer 30 along with the main binders include but are not limited to the ability of the foregoing material to offer improved levels of binding strength, water durability, and ink-coalescence control.

A further additional binder of interest involves a poly (vinyl pyrrolidone-vinyl acetate) copolymer. The basic structural formula for this poly(vinyl acetate-ethylene) copolymer is as follows:

$$(—CH_2CH(2\text{-pyrrolidone})—)_x(—CH_2CHOCOCH_3—)_y \quad (8)$$

(wherein x=about 500–15,000 and y=about 200–10,000 in a representative, non-limiting, and preferred embodiment).

This composition is commercially available from numerous sources including but not limited to Badische Anilin-& Soda-Fabrik Aktiengesellschaft (BASF) of Germany under the product designation "Luviskol® PVP/VA S-64W". The particular benefits provided by the use of a poly(vinyl pyrrolidone-vinyl acetate) copolymer in the ink-receiving layer 30 as an additional binder composition combined with the main binders include but are not limited to the ability of the above-mentioned composition to offer improved color gamut, better bleed performance, and greater color accuracy.

Regarding the additional binder compositions listed above (and others not specifically recited herein), the use of these materials may involve many different quantity values without limitation. Likewise, the employment of any given additional binders in combination with the main binders recited herein (namely, the First, Second, and Third Binders) will result in a situation where the chosen quantity of additional binder composition(s) will correspondingly reduce (in a proportionate fashion) the amounts of the main binders. However, it is preferred (but not necessarily required) that the minimum amount of each main binder not fall below the lower ends of the ranges set forth above in connection with the main binders. In an exemplary embodiment designed to produce optimum results, the ink-receiving layer 30 will contain therein about 55–100% by weight (optimum=about 60–75% by weight) total binder content therein which would include all of the binders in combination (namely, the First, Second, and Third Binders combined with any optional additional binder compositions). With continued reference to the use of additional binders in combination with the main binders, the ink-receiving layer 30 will contain, for example, the following representative and non-limiting quantity of additional binder compositions: about 0–10% by weight (optimum=about 0.5–3% by weight if the incorporation of such additional binder(s) is desired). These values will again involve the total (e.g. collective) amount of additional binder composition(s) being used whether a single additional binder is employed or multiple additional binders are employed in combination. However, these numerical values are being provided for example purposes only and may be appropriately varied as needed and desired.

Furthermore, the ink-receiving layer 30 may optionally employ therein along with the main binders at least one or more pigment compositions as another supplemental ingredient alone or combined with any of the other supplemental ingredients set forth herein. The term "pigment" or "pigment composition" shall generally be defined in a standard fashion to encompass a material which is used to impart color, opacity, and/or structural support (e.g. in a "filler" capacity) to a given formulation. The ink-receiving layer 30 shall not be restricted to any given pigment materials (organic or inorganic in nature), pigment quantities, and number of pigments in combination. For example, boehmite, pseudo-boehmite, or a mixture thereof can be used as an exemplary pigment composition in the ink-receiving layer 30 along with the binder blend discussed above (and any additional binder compositions if used). Between the two materials recited above, boehmite would be considered preferred. The terms "boehmite" and "pseudo-boehmite" shall be defined in a conventional fashion as would normally be understood by individuals skilled in the art to which this invention pertains. For example, boehmite traditionally involves a crystalline compound having the empirical formula AIO(OH) (including all physical forms in which boehmite exists or may otherwise be produced). In addition, "pseudo-boehmite" traditionally encompasses a type of boehmite having a higher water content than "regular" crystalline boehmite of the variety mentioned above (with pseudo-boehmite also being known as "gelatinous boehmite").

Employment of the above-mentioned materials (boehmite, pseudo-boehmite, or mixtures thereof in any proportion without limitation) are suitable for use as pigments in, the ink-receiving layer 30 because of their high porosity (which aids in rapid drying of the printed image), small particle size (in order to readily achieve desired levels of gloss and gloss-control), dispersion-stability (which assists in the overall manufacturing process), and relative transparency (to improve color saturation in connection with the printed image). Regarding preferred characteristics associated with the boehmite and/or pseudo-boehmite that are suitable for employment within the ink-receiving layer 30, such characteristics include but are not limited to: a particle size of about 10–400 nm (optimum=about 100–300 nm), a surface area of about 40–400 $m^2/g$ (optimum=about 40–150 $m^2/g$), a porosity of about 0.3–1 cc/g (optimum=about 0.5–0.7 cc/g), and a pore diameter of about 10–200 nm (optimum=about 50–70 nm). It should also be noted that a mixture of boehmite and pseudo-boehmite can be used as the pigment composition (with the mixture as a whole being considered the "composition").

Boehmite and/or pseudo-boehmite materials which can be employed for the purposes listed herein (namely, for use as a pigment in the ink-receiving layer 30 or other layers expressed herein) can be obtained from many commercial sources including but not limited to Sasol Chemical Industries, Inc. of Hong Kong, China under the product designation/trademark "Catapal®". This proprietary material generally has at least one or more of the chemical and physical characteristics listed above and consists primarily of boehmite possibly containing minor amounts of pseudo-boehmite combined therewith.

Other pigments which can be employed in the ink-receiving layer 30 (alone or in combination with any of the various supplemental ingredients discussed herein) include but are not limited to silica (in precipitated, colloidal, gel, sol, and/or fumed form), cationic-modified silica (e.g. alumina-treated silica in an exemplary and non-limiting embodiment), cationic polymeric binder-treated silica, magnesium oxide, polyethylene beads, polystyrene beads, magnesium carbonate, calcium carbonate, barium sulfate, clay, titanium dioxide, gypsum, mixtures thereof, and others. Silica gel is of particular interest within this group as an alternative pigment, with such composition typically being fabricated by combining mineral acid materials with silicates (sodium silicate and the like). The resulting product consists of an aggregated network-type structure within a liquid medium. While the present invention (with particular reference to the ink-receiving layer 30) shall not be restricted to any types or grades of silica if used, a representative silica gel composition suitable for employment therein (if desired) will have an exemplary/preferred mean silica particle size (e.g. diameter) of about 0.3–0.4 $\mu$m in water and an exemplary/preferred mean porosity of about 0.8–0.9 cc/g which provides excellent results. This particular silica material is commercially available from, for example, Grace Davison, Inc. of Columbia, Md. (USA) under the product designation "GD009B". Likewise, it should be understood that the use herein of the general term "silica" (which is likewise known as "silicon dioxide") shall be interpreted to encompass any of the individual silica forms listed above alone or in any combination.

As previously stated, the incorporation of at least one or more pigments in the ink-receiving layer 30 shall be considered optional. However, if used, the quantity values associated with the pigment-content of the ink-receiving layer 30 shall not be limited to any given amounts. An exemplary and preferred ink receiving layer 30 will contain about 5–40% by weight pigment composition (optimum= about 10–35% by weight). It should again be noted that the numerical parameters recited above shall represent the total (e.g. collective) amount of pigment(s) being used whether a single pigment is employed or multiple pigments are employed in combination. In other words, if a plurality of pigments are chosen for incorporation within the ink-receiving layer 30, it is preferred that the plurality (considered as a whole from a quantity standpoint) fall within the above-listed numerical parameters.

Next, at least one or more other supplemental ingredients can be incorporated within the ink-receiving layer 30 and combined with the main binders discussed above (with or without any additional binders and/or pigments as previously described). All of these materials should be considered optional in nature and can be omitted entirely although it is preferred that at least one or more of them be used. These other supplemental ingredients include but are not restricted to:

1. Lactic Acid: This material (which generally involves the formula $C_3H_6O_3$) can be employed to aid in dispersing the pigment composition(s) if used (with particular reference to the selection of boehmite, pseudo-boehmite, or a mixture thereof). A representative and non-limiting quantity of lactic acid which may be included within the ink-receiving layer 30 (if the use of this material is desired) involves about 0.5–4% by weight of the layer 30 (optimum=about 1–2% by weight of the layer 30).

2. At least one compound which is characterized herein as a "defoamer composition". This material may be employed during fabrication of the ink-receiving layer 30 in order to reduce and otherwise eliminate the formation of undesired foam (e.g. bubbles) in the coating formulation that will ultimately become the ink-receiving layer 30. The use of at least one defoamer composition can therefore avoid the presence of bubbles and/or air-pockets within the completed ink-receiving layer 30. The defoamer compositions of primary interest also perform a surfactant function and, accordingly, the phrase "defoamer composition" should be broadly construed to encompass at least one or more surfactants.

Exemplary commercially-available products (some or all of which may be considered to have proprietary formulations) which can be used as defoamer compositions in the ink-receiving layer 30 if desired include but are not limited to the following materials: (A) an oil-based product sold by Henkel KGaA of Germany under the product designation/trademark: "Foammaster VFS"; (B) an oil-based product sold by Cognis Corporation of Cincinnati, OH (USA) under the product designation/trademark "Foamstar® A12"; (C) a non-ionic surfactant-type product sold by Air Products and Chemicals, Inc. of Allentown, Pa. (USA) under the product designation/trademark "Surfynol® 420"; (D) polyethylene oxide which, for example, is commercially available from Air Products and Chemicals, Inc. of Allentown, Pa. (USA) under the product designation/ trademark "Triton X100"; and (E) a fluorosurfactant, with a commercial fluorosurfactant product being obtainable from Ciba Specialty Chemicals, Inc. of Tarrytown, N.Y. (USA) under the product designation/trademark "Lodyne®". Again, these materials are being recited for example purposes only and, accordingly, the claimed invention shall not be restricted to any of the compositions listed above (or the use of defoamers/surfactants in general).

A single defoamer composition or multiple defoamer compositions can be employed in combination when producing the ink-receiving layer 30. In this regard, the ink-receiving layer 30 shall not be restricted to any particular defoamer composition types, amounts, or combinations. If it is desired that one or more defoamer compositions be included in the completed ink-receiving layer 30, the layer 30 will contain in a representative embodiment about 0.02–2% by weight defoamer composition therein (optimum=about 0.1–1% by weight). These quantity values shall again be construed to involve the total (e.g. collective) amount of defoamer composition(s) being used whether a single defoamer is employed or multiple defoamers are used in combination.

3. At least one compound designated herein as a "slip agent". This material can be used in the ink-receiving layer 30 in order to provide numerous benefits. These benefits include, for instance, a reduction in the surface friction levels of the completed ink-receiving layer 30 In order to make it smoother and more readily transferrable through the printer unit(s) of interest. A variety of different commercially-available compositions can be employed for this purpose including those sold under the "Slip-Ayd®" trademark by Elementis Specialties of Heightstown, N.J. (USA) with particular reference to, for instance, a compound bearing the product designation/trademark "SL 1618". This material basically involves an oxidized polyethylene composition. Other slip agents that can be used alone or in combination with each other (and the SL 1618 material recited above) include, for instance, polytetrafluoroethylene beads which, are commercially available from, for example, Shamrock Technologies, Inc. of Newark, N.J. (USA) under the product designation/trademark "Fluoro AQ-50". Additional "bead-type" slip agent products which can also be employed alone or combined with the other slip agents discussed herein include but are not limited to those which are fabricated from polystyrene beads.

In certain circumstances, silicon dioxide (e.g. silica) in substantially the same form(s) discussed above with respect to the optional pigment compositions can also be used for slip agent purposes. Regarding the quantity of slip agent to be included within the ink-receiving layer 30 (if the use of this material is desired), the present invention shall not be limited to any particular numerical amounts. However, in a preferred and non limiting embodiment, the ink-receiving layer 30 will contain about 0.25–5% by weight slip agent (optimum=about 0.5–2% by weight) if it is determined that a slip agent should be included. Again, these quantity values shall be construed to involve the total (e.g. collective) amount of slip agent(s) being employed whether a single slip agent or multiple slip agents in combination are used. Likewise, the quantity of slip agent may exceed the values recited above if the composition chosen for this purpose also simultaneously performs another function (e.g. as a pigment with reference to, for example, silica).

4. At least one composition designated herein as a "pH modifier". This material is specifically used during formulation of the ink-receiving layer 30 in order to achieve a desired pH level during this process (with a preferred pH level being approximately 3–6). Representative materials suitable for this purpose include but are not limited to nitric acid, acetic acid, lactic acid, citric acid, and mixtures thereof. All of the embodiments discussed herein (and the various layers associated therewith) may use widely varying amounts of the chosen pH modifier in order to achieve a desired pH level (optimally but not necessarily within the foregoing preferred range). However, as a general guideline, the ink-receiving layer 30 will typically employ about 0.1–0.5% weight (optimum=about 0.2–0.4% by weight) of the pH modifier with the understanding that this amount may be varied as needed (or eliminated entirely) in accordance with routine preliminary pilot testing.

5. At least one "gelatin hardener" composition. This material is specifically used to harden and otherwise assist in the overall solidification of the gelatin materials employed in connection with, for instance, the First Binder. In this manner, the gelatin is able to perform an enhanced binding function and otherwise offer an added degree of strength and durability to the completed ink-receiving layer 30. Representative and preferred gelatin hardener materials include but are not limited to pyridinium-carbamoyl, metal oxides, aldehydes, amides, and vinyl sulfone. If employed (which, in fact, would be considered preferred), a representative and non-limiting amount of gelatin hardener in the ink-receiving layer 30 would be about 0.1–1% by weight (optimum=about 0.3–0.8% by weight) which is again subject to modification if needed and desired in accordance with routine preliminary analysis.

6. At least one "ink fixative", with this term being generally defined herein to involve a material which chemically, physically, or electrostatically binds with or otherwise fixes the ink materials of interest to, within, or on the ink-receiving layer 30. This material is used in order to further foster a high degree of water-fastness, smear-fastness, and overall image stability. An exemplary composition suitable for this purpose (if the use thereof is desired) involves at least one material known as a "cationic emulsion polymer", with this term being generally defined herein to encompass a polymer produced through an emulsion polymerization process that contains at least one monomer that is cationic in nature (e.g. positively-charged) such as a protonated amine (e.g. a primary, secondary, or tertiary amine) or a quaternized (e.g. quaternary) amine. Representative quaternary amine cationic monomers include but are not limited to trimethylammonium ethyl acrylate chloride, trimethylammonium ethyl acrylate methyl sulfate, benzyldimethylammonium ethyl acrylate chloride, benzyldimethylammonium ethyl acrylate methyl sulfate, benzyldimethylammonium ethyl methacrylate chloride, and benzyldimethylammonium ethyl methacrylate methyl sulfate. A cationic emulsion polymer of particular interest which is especially effective in offering the above-mentioned benefits comprises a quaternary amine cationic emulsion polymer as noted above (also designated herein in abbreviated form as a "quaternary amine emulsion polymer"). In general, quaternary amine compounds basically involve compounds that contain four alkyl and/or aryl groups (all the same, different, or mixtures thereof without limitation) that are bound to a central nitrogen atom. The term "quaternary amine emulsion polymer" shall be construed to encompass cationic emulsion polymers as previously defined which contain at least one quaternary amine compound or group.

An exemplary and preferred quaternary amine emulsion polymer which may be employed as the cationic emulsion polymer ink fixative in the ink-receiving layer 30 (if desired) involves a proprietary composition that is commercially available from the Rohm and Haas Company of Philadelphia, Pa. (USA) under the product designation/trademark "Primal® PR-26". This material is especially effective and useful in preventing gellation and/or viscosification problems which can occur when relatively large amounts of pigment materials such as boehmite and/or pseudo-boehmite are employed. The benefits offered by the above-listed composition result at least partially from the fact that it has a high glass transition temperature ($T_g$) (e.g. the temperature at which a liquid changes to a glass-like solid composition) and/or a high crosslinking capability. Specific characteristics of the "Primal® PR-26" composition include an acrylic polymer content of about 27–29% by weight, an alkylaryl polyether alcohol content of about 2–4% by weight, a water content of about 69–70% by weight, a pH of about 7.0–8.0, a solids content of about 30.0–31.0% by weight, a viscosity of about 200–800 cps, and a weight per gallon of about 8.9 lb./gal. Additional information regarding quaternary amine cationic emulsion polymers is provided in, for example, U.S. Pat. No. 5,312,863 which is incorporated herein by reference in its entirety.

In a preferred embodiment, the ink-receiving layer 30 of the present invention will comprise about 1–20% by weight (optimum=about 5–15% by weight) of the chosen ink fixative(s) if the use thereof is desired. As previously noted, this value will involve the total (e.g. collective) amount of ink fixative(s) being used whether a single compound is employed or multiple compositions are used in combination.

Various other supplemental ingredients can be incorporated within the ink-receiving layer 30 in addition to or instead of those recited above without limitation including biocides (for example, chlormetakresol), UV/light protectants, fade-control agents, fillers, preservatives (e.g. antioxidants), buffers, and the like in varying amounts as determined by routine preliminary pilot analysis. Each of these ingredients may be used in a variety of different concentration levels without restriction although a typical quantity value associated with each of the ingredients recited in this paragraph may involve about 0.005–10% by weight (optimum=about 1–8% by weight), with this range being subject to variation as needed and desired. Accordingly, the claimed invention shall not be restricted to any given supplemental ingredients or amounts thereof (which can be eliminated entirely if desired).

It should also be noted that, expressed in a different manner, the present invention shall likewise be construed to cover a specialized coating formulation (also characterized herein as a "coating composition") that is used to produce the novel ink-receiving layer 30. This coating formulation will preferably be in fluidic (e.g. "fluid-containing") form and will contain at least one liquid carrier medium if needed and desired as determined by preliminary pilot testing. Exemplary carrier media include water, organic solvents (e.g. n-methyl pyrrolidone, 2-propanol, or butanol), or mixtures thereof, with water as the sole carrier medium being preferred. The coating formulation will contain (at the very least in a preferred embodiment) the binder blend discussed above. This binder blend again comprises: (1) the First Binder (gelatin); (2) the Second Binder (a poly(vinyl alcohol-ethylene oxide) copolymer); and (3) the Third Binder (a poly((styrene)-(n-butyl acrylate)-(methyl methacrylate)-(2-(tert-butylamino) ethyl methacrylate)) copolymer. Any or all of the supplemental ingredients recited above in connection with the ink-receiving layer 30 may be employed within the coating formulation in combination with the binder blend. In this regard, the foregoing discussion of these supplemental ingredients (and all of the other information associated therewith including quantity data) are incorporated in the current discussion by reference.

Regarding the liquid carrier medium, it is preferably about 50–100% by weight water (optimally about 80–100% by weight water), with the balance involving organic solvents such as n-methylpyrrolidone, 2-propanol, butanol, or mixtures thereof without limitation. The coating formulation will typically have a solids-content of at least about 20% by weight or more, with a preferred solids-content range being about 20–45% by weight (optimum=about 25–40% by weight). These % by weight values will involve the total amount of solids in the entire fluid-containing coating formulation (e.g. wet weight). However, the foregoing percentage values shall be considered representative only and again may be varied as needed and desired with reference to the type of print media product 10 that is chosen and the intended uses thereof.

A number of different techniques may be employed to apply, form, or otherwise deliver the ink-receiving layer 30 in position over and above the substrate 12 (and/or coating layer 20 associated therewith if present). Formation of the ink-receiving layer 30 is typically accomplished by coating the substrate 12 (and/or coating layer 20 if used) with the coating formulation (discussed above). The coating formulation will again contain all of the above-listed ingredients (incorporated in the current description by reference). A number of different delivery/coating methods may be implemented for this purpose including but not limited to the use of a conventional slot-die processing system, meyer bar apparatus, curtain coating system, rod coating device, brush delivery applicator, spraying unit, or other comparable techniques/devices including those that employ circulating and non-circulating coating technologies. An exemplary coating weight range associated with the ink-receiving layer 30 (irrespective of the coating method that is employed) is about 5–13 g/m$^2$ (optimum=about 8–10 g/m$^2$) with reference to the completed (e.g. dried) layer 30. However, the claimed invention and its various embodiments shall not be restricted to any particular layer application/formation methods (and coating weights) with a number of different alternatives being employable.

Once the above-listed coating composition is applied to the substrate 12/coating layer 20 (if used), it shall be characterized hereinafter as the ink-receiving layer 30. After this step, the substrate 12 having the layer 30 thereon is preferably dried. This may be accomplished by heating the substrate 12/layer 30 combination at a preferred and non-limiting temperature of about 80–120° C. (optimum=about 90–110° C.) within a conventional oven-type heating apparatus of a variety normally used for fabricating sheet-type print media products. The substrate 12/layer 30 combination will typically move through the heating apparatus at a representative "web speed" of about 500–2000 ft./minute (optimum=about 1500–2000 ft./minute). However, it shall also be understood that other drying methods may be implemented without limitation provided that the compositions associated with the ink-receiving layer 30 are effectively dried at this stage. The overall thickness of the print media product 10 illustrated schematically in FIG. 2 may readily be determined by simply adding up all of the aforementioned thickness values "T", "$T_1$", and "$T_2$" associated with the substrate 12, coating layer 20 (if used), and ink-receiving layer 30, respectively. The total thickness of the print media product 10 can, of course, be appropriately varied depending on the number of any additional layers that may be employed within the print media product 10.

Figure 3:
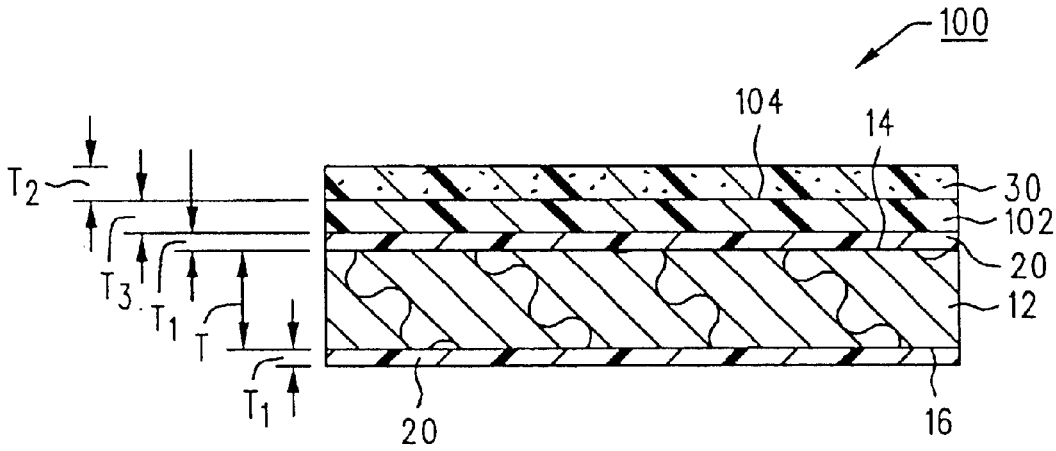
FIG. 3 is a schematically-illustrated and enlarged partial cross-sectional view of a completed print media product produced in accordance with an alternative embodiment illustrating the material layers and thicknesses associated therewith.

As stated throughout the current discussion, a variety of different versions of this invention are possible provided that at least one ink-receiving layer 30 is used which contains the claimed material combinations. The layer 30 may be located anywhere on or within the print media product 10 without limitation as long as it is able to receive at least some of the ink compositions being delivered. At this point, an alternative embodiment of the invention will now be discussed. This embodiment will involve all of the information, materials, numerical parameters, thickness values, fabrication techniques, definitions, procedures, and other items mentioned above in connection with all of the structures of the first embodiment shown in FIG. 2. Thus, all of these items are incorporated in the current discussion by reference unless otherwise expressly stated herein and will therefore not be repeated. In fact, the only difference between the embodiment of FIG. 2 and the embodiment which will now be discussed (as illustrated in FIG. 3) involves the placement of at least one additional layer of material between the ink-receiving layer 30 as previously described and the upper surface 14 of the substrate 12 if uncoated (or the coating layer 20 on the upper surface 14 if coated). Component numbers carried forward from one embodiment to another (namely, from the embodiment of FIG. 2 to the embodiment of FIG. 3) shall represent structures which are common to all embodiments.

As previously mentioned, the print media product 10 may contain at least one additional layer of material (also known as an "additional material layer") located above or below the ink-receiving layer 30. A non-limiting example of a print media product 100 which employs an additional layer of material is schematically illustrated in FIG. 3. This additional material layer (likewise characterized herein as a "medial layer" or "intermediate layer" in the embodiment of FIG. 3) is shown at reference number 102. As per FIG. 3, it is positioned over and above (e.g. operatively attached to) the upper surface 14 of the substrate 12 (with or without the coating layer 20) and is therefore "supported" by the substrate 12 as previously defined. In a preferred (but not necessarily required) embodiment, the additional material layer 102 is "directly affixed" to the upper surface 14/coating layer 20. This phrase is defined to involve direct attachment of such components to each other without any intervening materials or layers therebetween. Likewise, the ink-receiving layer 30 is positioned over and above (e.g. "supported" by as previously defined) the top or upper surface 104 of the additional material layer 102 with "direct affixation" of such components being preferred (although not required). It should also be understood that further layers of material (not shown) may be located below the additional material layer 102 (between the layer 102 and substrate 12 whether coated or uncoated) or above the additional material layer 102 (between the layer 102 and ink-receiving layer 30) without limitation. A representative and non-limiting thickness value "$T_3$" associated with the additional material layer 102 will be about 1–50 $\mu$m (optimum=about 10–40 $\mu$m).

The additional material layer 102 may be made from a number of different ingredients including but not limited to pigment compositions, binders, fillers, defoamer compositions, lubricants, UV/light stabilizers, biocides, buffers, fade-control agents, lactic acid, pH modifiers, slip agents, preservatives (e.g. antioxidants), general stabilizers, ink fixatives, hardeners, and others alone or combined without restriction. In particular, all of the ingredients recited above in connection with the ink-receiving layer 30 may also be employed within the additional material layer 102 alone or in various combinations without limitation regarding the number, type, and quantity thereof. Thus, all of the data listed herein involving the ink-receiving layer 30 and the various compositions which can be used in the layer 30 is equally applicable to the additional material layer 102 and incorporated in the current discussion by reference. For example, the additional material layer 102 may contain at least one pigment composition (without any binders), at least one binder (without any pigment compositions), or a mixture of at least one pigment composition and at least one binder. Furthermore, one or more of the other additional/supplemental materials recited above in connection with the ink-receiving layer 30 can also be employed, with the additional material layer 102 not being limited in connection with any types, amounts, or quantities of ingredients as previously stated. Exemplary pigments that can be incorporated within the additional material layer 102 comprise those listed above in connection with the ink-receiving layer 30, namely, boehmite, pseudo-boehmite, silica (in precipitated, colloidal, gel, sol, and/or fumed form), cationic-modified silica (e.g. alumina-treated silica in an exemplary and non-limiting embodiment), cationic polymeric binder-treated silica, magnesium oxide, polyethylene beads, polystyrene beads, magnesium carbonate, calcium carbonate, barium sulfate, clay, titanium dioxide, gypsum, mixtures thereof, and others without limitation.

Representative binders suitable for use in the additional material layer 102 will also involve those recited herein with respect to the ink-receiving layer 30 including but not limited to polyvinyl alcohol (as defined above) and derivatives thereof (including but not limited to acetoactylated polyvinyl alcohol), starch, SBR latex, gelatin, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl alcohol-ethylene oxide) copolymer, a poly(vinyl acetate-ethylene) copolymer, a poly(vinyl pyrrolidone-vinyl acetate) copolymer, a poly((styrene)-(n-butyl acrylate)-(methyl methacrylate)-(2-(tert-butylamino) ethyl methacrylate)) copolymer, mixtures thereof, and others without limitation. Again, all of the information provided above involving construction materials, ingredient quantities, and the like in connection with the ink-receiving layer 30 is incorporated by reference regarding the additional material layer 102. Nonetheless, with respect to ingredient quantities, such values are subject to change as needed and desired in accordance with routine preliminary pilot tests involving a variety of factors Including the intended uses associated with the print media product 100.

A number of different methods may be employed to apply, form, or otherwise deliver the compositions associated with the additional material layer 102 in position over and above the substrate 12 (and/or coating layer 20 if present). Representative application techniques which can be chosen for this purpose include but are not limited to the use of a slot-die processing system, meyer bar apparatus, curtain coating system, rod coating device, brush delivery applicator, spraying unit, or other comparable methods including those that employ circulating and non-circulating coating technologies. An exemplary coating weight range associated with the additional material layer 102 (irrespective of the coating method that is employed) is about 17–27 g/m$^2$ (optimum=about 20–24 g/m$^2$) with reference to the completed (e.g. dried) layer 102. However, the claimed invention and its various embodiments shall not be restricted to any particular layer application/formation methods (and coating weights) with a number of different alternatives being employable for this purpose. Once the ingredients which are used to form the additional material layer 102 are applied to the substrate 12 (and coating layer 20 if employed), such materials shall be characterized hereinafter as the additional material layer 102. After this step, the substrate 12 having the additional material layer 102 thereon is preferably dried. This may be accomplished by heating the substrate 12/layer 102 combination at a preferred and non-limiting temperature of about 80–120° C. (optimum=about 90–110° C.) within a conventional oven-type heating apparatus of a variety normally used for fabricating sheet-type print media products. The substrate 12/layer 102 combination will typically move through the heating apparatus at a representative "web speed" of about 500–2000 ft./minute (optimum=about 1500–2000 ft./minute). However, other drying methods may be employed without limitation provided that the compositions associated with the additional material layer 102 are effectively dried at this stage.

Thereafter, the ink-receiving layer 30 can be applied, delivered, or otherwise formed onto the top surface 104 of the additional material layer 102 so that it is operatively attached thereto. This step may be accomplished using the techniques, methods, operational parameters, web speeds, coating weights, and other information (including drying steps, temperatures, and the like) which are listed above in connection with the ink-receiving layer 30. Such information shall therefore be incorporated in the current discussion by reference.

Figure 4:
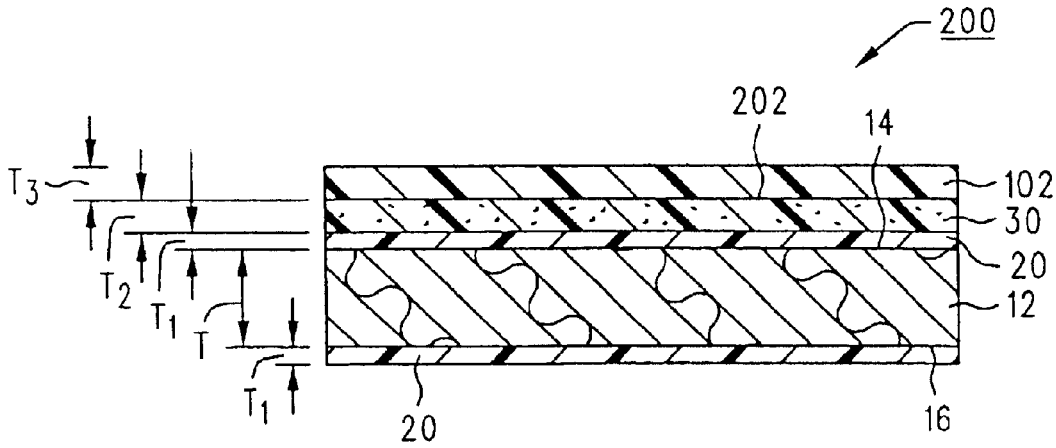
FIG. 4 is a schematically-illustrated and enlarged partial cross-sectional view of a completed print media product produced in accordance with a still further alternative embodiment illustrating the material layers and thicknesses associated therewith.

An even further embodiment is illustrated in FIG. 4 which includes all of the information, materials, parameters, data, construction methods, and the like that pertain to the previously-described embodiments of FIGS. 1–3. These items are incorporated by reference in connection with the embodiment of FIG. 4 and thus will not be repeated. The only difference between the embodiments of FIGS. 3 and 4 is the layer-order with respect to the ink-receiving layer 30 and additional material layer 102. In the print media product 200 of the FIG. 4, additional material layer 102 is on top (e.g. is the "outermost" material layer) while, in the print media product 100 of FIG. 3, the ink-receiving layer 30 is on top (namely, "outermost"). Specifically, as shown in FIG. 4, the additional material layer 102 is positioned over and above (e.g. "operatively attached to") the top surface 202 of the ink-receiving layer 30. Everything else in connection with the embodiments of FIGS. 3 and 4 is the same. In order to produce the embodiment of FIG. 4, the following step is undertaken: placing (or "forming" which shall be considered equivalent to "placing") at least one additional layer of material (e.g. additional material layer 102) in position over and above the ink-receiving layer 30. Both of the embodiments of FIGS. 3–4 may, if desired, include even further layers in a variety of locations without limitation.

At this point, the basic manufacturing process is completed regarding all of the embodiments recited herein. From a physical, chemical, and structural standpoint, the ink-receiving layer 30 produced in accordance with the invention can be expected in most cases to have the following important characteristics: an average drying time of about 1–2 minutes and a specular gloss of about 40–70 at 20° (which may be measured using a Micro-TRI-Gloss meter (P/N GB4520) from BYK Gardner USA of Columbia, Md. (USA)), with the foregoing numerical parameters being non-limiting but preferred.

Furthermore, as previously stated, the ink-receiving layer 30 (and additional material layer 102 if used) can be placed on either or both surfaces 14, 16 of the substrate 10 (whether coated or uncoated). If an embodiment is provided wherein the ink-receiving layer 30 (and additional material layer 102 if used) is placed on only one side (e.g. upper surface 14 or lower surface 16) of the substrate 12, the opposite side can employ one or more layers of material thereon which are used for "anti-curl" purposes. This particular layering arrangement is typically implemented in order to prevent the print media product 10 from curling, rolling-up, and the like before, during, or after a printing operation. A representative anti-curl layer or layers may be made from any of the compositions (and combinations thereof) which are listed above in connection with the additional material layer 102 and/or ink-receiving layer 30 without limitation. In this regard, all of the information set forth herein concerning layers 30, 102 is equally applicable to the use of any anti-curl layers (which may also contain one or more other ingredients not expressly identified above).

The following Example is provided as a preferred version of a print media product 10 which incorporates the ink-receiving layer 30. It shall be understood that the recitation of this Example will not limit the invention in any respect.

EXAMPLE

In this Example (which corresponds with the print media product 10 of FIG. 2), the substrate 12 is constructed from a commercial paper product that is pre-coated on both surfaces/sides 14, 16 with a coating layer 20 which is comprised of, for instance, polyethylene. The thickness values and coating weights associated with the substrate 12, coating layer 20, and ink-receiving layer 30 are within the numerical ranges specified above. No other ink receiving layers (or layers of any other kind) are employed in this Example.

| Component | By Dry Weight in Layer |
|---|---|
| Silica-(pigment-type: colloidal) | 3.5 |
| Polystyrene beads-(pigment | 3.5 |
| Gelatin-(First Binder) | 18.2 |
| Poly(vinyl alcohol-ethylene oxide) copolymer (Second Binder) | 45.5 |
| Poly((styrene)-(n-butyl acrylate)-(methyl methacrylate)-(2-(tert-butylamino) ethyl methacrylate)) copolymer-(Third Binder) | 18.2 |
| Methylhydroxy cellulose-(Additional Binder) | 9.1 |
| Fluorosurfactant-("Lodyne ®") | 2.0 |
| | 100 |

The ink-receiving layer 30 discussed in the above-listed Example may be used alone (namely, without any additional material layer(s) 102) or in combination with one or more of the additional material layer(s) 102 discussed above. Likewise, the ink-receiving layer 30 may be placed on either or both surfaces 14, 16 of the substrate 12 (whether coated or uncoated) as needed or desired.

From a method standpoint, the basic process of interest which is applicable to all of the foregoing embodiments will generally involve the following steps: (1) providing a substrate; and (2) forming an ink-receiving layer in position over and above the substrate (whether coated or uncoated) or, more generally, operatively attaching the ink-receiving layer to the substrate so that the ink-receiving layer is "supported" by the substrate. The ink receiving layer can involve all of the particular formulations listed above in connection with ink-receiving layer 30, with such formulations being incorporated by reference in the current discussion with respect to the claimed methods. Likewise, as previously noted, the term "forming" as used and claimed herein shall be construed in the broadest sense possible and will generally signify the creation and placement (as a whole) of the completed (e.g. dried) ink-receiving layer 30 on the substrate 12/coating layer 20 (if used).

In a still further embodiment of the claimed method, the print media product 10 may be provided with at least one additional layer of material (also known as an "additional material layer") thereon or therein (see the embodiments of FIGS. 3–4). For example, in order to produce the embodiment of FIG. 3, the following step is undertaken: placing (or "forming" which shall generally be considered equivalent to "placing") at least one additional or intermediate layer of material (e.g. additional material layer 102) in position over and above the substrate 12/coating layer 20 prior to application of the ink-receiving layer 30. This step specifically involves placing the additional material layer 102 between the substrate 12/coating layer 20 (if used) and the ink-receiving layer 30 so that the additional material layer 102 is operatively attached to both the substrate 12/coating layer 20 and the ink-receiving layer 30. The additional material layer 102 can encompass all of the particular formulations recited above in connection with this structure, with such formulations being incorporated herein by reference in the current discussion.

In order to produce the embodiment of FIG. 4, the following step is undertaken after application of the ink-receiving layer 30: placing (or "forming" which shall generally be considered equivalent to "placing") at least one additional layer of material (e.g. additional material layer 102) in position over and above the top surface 202 of the ink-receiving layer 30. In this manner, the additional material layer 102 is operatively attached to the ink-receiving layer 30.

Having set forth herein preferred embodiments of the invention, it is anticipated that various modifications may be made thereto by individuals skilled in the relevant art which nonetheless remain within the scope of the invention. For example, the invention shall not be limited to any particular ink delivery systems, operational parameters, numerical values, dimensions, ink compositions, layering arrangements, print media components, substrates, material proportions/quantities, and component orientations unless otherwise explicitly stated herein. The present invention shall therefore only be construed in accordance with the following claims.

What is claimed:

1. A print media product comprising:

a substrate; and at least one ink-receiving layer supported by said substrate, said ink-receiving layer being comprised of a plurality of binder compositions, said plurality of binder compositions comprising a first binder comprised of gelatin, a second binder comprised of a poly(vinyl alcohol-ethylene oxide) copolymer, and a third binder comprised of a copolymer of at least one polystyrene, at least one polyalkyl methacrylate and at least one polyalkyl acrylate.

2. The print media product of claim 1 wherein said ink-receiving layer is comprised of about 10–30% by weight said first binder.

3. The print media product of claim 1 wherein said ink-receiving layer is comprised of about 30–55% by weight said second binder.

4. The print media product of claim 1 wherein said ink-receiving layer is comprised of about 10–30% by weight said third binder.

5. The print media product of claim 1 wherein said ink-receiving layer further comprises at least one pigment therein.

6. The print media product of claim 5 wherein said ink-receiving layer is comprised of about 5–40% by weight said pigment.

7. The print media product of claim 1 wherein said plurality of binder compositions further comprises at least one additional binder therein which is different from said first binder, said second binder, and said third binder.

8. The print media product of claim 1 wherein said print media product further comprises at least one additional material layer.

9. The print media product of claim 1 wherein said print media product further comprises at least one ingredient selected from the group consisting of defoamer compositions, biocides, hardeners, UV/light stabilizers, buffers, slip agents, pH control compounds, preservatives, and lactic acid.

10. The print media product of claim 8 wherein said additional material layer is located between said substrate and said ink-receiving layer, said additional material layer comprising at least one composition therein selected from the group consisting of at least one pigment, at least one binder, and a mixture thereof.

11. A print media product comprising:

a substrate; and at least one ink-receiving layer supported by said substrate, said ink-receiving layer being comprised of about 10–30% by weight of a first binder comprised of gelatin, about 30–55% by weight of a second binder comprised of a poly(vinyl alcohol-ethylene oxide) copolymer, and about 10–30% by weight of a third binder comprised of a copolymer of at least one polystyrene, at least one polyalkyl methacrylate and at least one polyalkyl acrylate.

12. A print media product comprising:

a substrate; and at least one ink-receiving layer supported by said substrate, said ink-receiving layer being comprised of:

a first binder comprised of gelatin;

a second binder comprised of a poly(vinyl alcohol-ethylene oxide) copolymer; a third binder comprised of a copolymer of at least one polystyrene, at least one polyalkyl methacrylate and at least one polyalkyl acrylate;

an additional binder comprised of methylhydroxypropyl cellulose;

a first pigment comprised of silica; and a second pigment comprised of polystyrene beads.

* * * * *